United States Patent [19]

Bolander et al.

[11] Patent Number: 4,473,045

[45] Date of Patent: Sep. 25, 1984

[54] METHOD AND APPARATUS FOR CONTROLLING FUEL TO AN ENGINE DURING COOLANT FAILURE

[75] Inventors: William J. Bolander, Lafayette, Ind.; Max A. Freeman, Troy; Eudell G. Jacobsen, Romeo, both of Mich.

[73] Assignee: General Motors Corporation, Detroit, Mich.

[21] Appl. No.: 570,801

[22] Filed: Jan. 16, 1984

[51] Int. Cl.[3] ..... F02D 17/02; F02B 77/08

[52] U.S. Cl. ..... 123/198 F; 123/41.15; 123/481; 123/198 D

[58] Field of Search ..... 123/198 F, 198 D, 198 DB, 123/41.15, 481

[56] References Cited

U.S. PATENT DOCUMENTS

| | | | |
|---|---|---|---|
| 4,080,947 | 3/1978 | Iizuka | 123/198 F |
| 4,134,261 | 1/1979 | Iizuka et al. | 60/276 |
| 4,146,006 | 3/1979 | Garabedian | 123/198 F |
| 4,227,505 | 10/1980 | Larson et al. | 123/198 F |
| 4,276,863 | 7/1981 | Sugasawa et al. | 123/198 F |
| 4,292,938 | 10/1981 | Tanaka et al. | 123/198 F |

*Primary Examiner*—Ira S. Lazarus

*Attorney, Agent, or Firm*—Howard N. Conkey

[57] ABSTRACT

A fuel control system for an internal combustion engine senses a failure in the coolant system and supplies fuel alternately to each of the two cylinder banks for predetermined periods of time so that one of the cylinder banks is supplied with an air and fuel mixture to power the engine and the other one of the cylinder banks is supplied with air only to be cooled thereby to extend the safe operating time of the engine. The air/fuel ratio of the mixture supplied to the bank provided with a combustible mixture is adjusted to limit the speed of the vehicle to further extend the safe operating time of the engine.

4 Claims, 2 Drawing Figures

METHOD AND APPARATUS FOR CONTROLLING FUEL TO AN ENGINE DURING COOLANT FAILURE

This invention relates to a method and apparatus for controlling the air and fuel mixture supplied to an internal combustion engine during the period of a cooling system failure so as to extend the operating time of the engine.

It is well known that extended operation of a vehicle internal combustion engine after a failure occurs in the cooling system of the engine will generally result in damage to the engine due to the resulting excessive engine temperature. When a failure occurs that results in loss of engine coolant or a blockage preventing the circulation of the coolant, the time that it takes for the temperature to rise to a level resulting in engine damage is relatively short and would not allow the operator to drive the vehicle to a location where repairs may be made. It would be desirable upon the occurrence of a coolant system failure to extend the safe operating time of the engine and therefore the operating range of the vehicle to allow the vehicle to be driven to a location at which assistance may be obtained.

It is the general object of this invention to provide a system for controlling the engine operation subsequent to a coolant system failure in a manner that extends the safe operating time and range of a vehicle.

It is another object of this invention to sense the occurrence of an engine coolant system failure and adjust the operating conditions of the engine so as to decrease the rate of increase in the engine temperature and extend the safe operating time of the engine.

It is another object of this invention to extend the safe operating time of an engine in the event of a coolant system failure by control of the air and fuel mixture supplied to the individual cylinders of the engine.

In general, the safe operating time of an engine during a coolant system failure is extended in accord with this invention by (1) alternately inhibiting the supply of fuel to the two groups of cylinders in the two banks of cylinders of the engine for predetermined time periods so that each of the banks of cylinders alternately induct an air and fuel mixture and air only so that the cylinders are cooled while inducting air only and (2) the air/fuel ratio of the mixture inducted by the cylinder bank having fuel supplied thereto is controlled to limit the vehicle speed.

Figure 1:
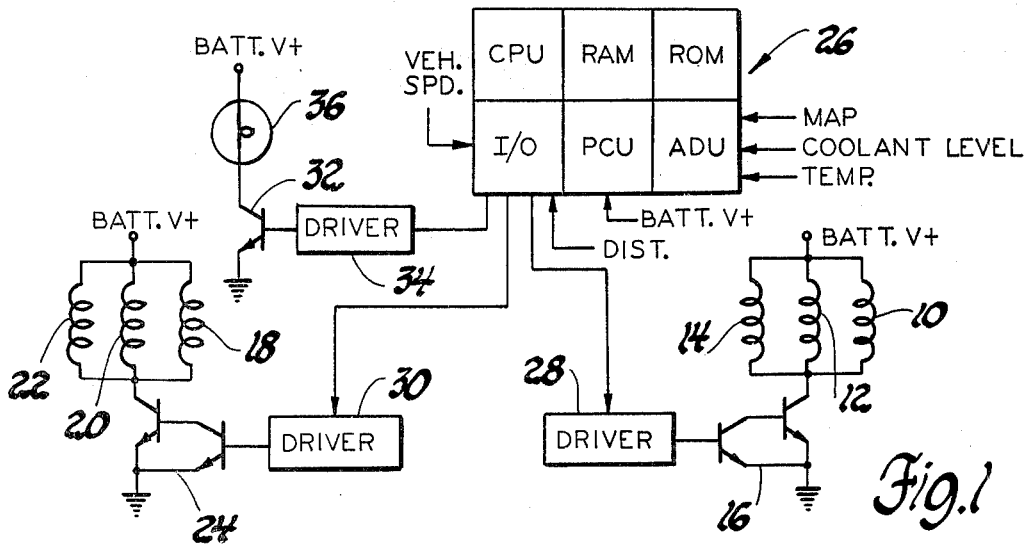
Figure 2:
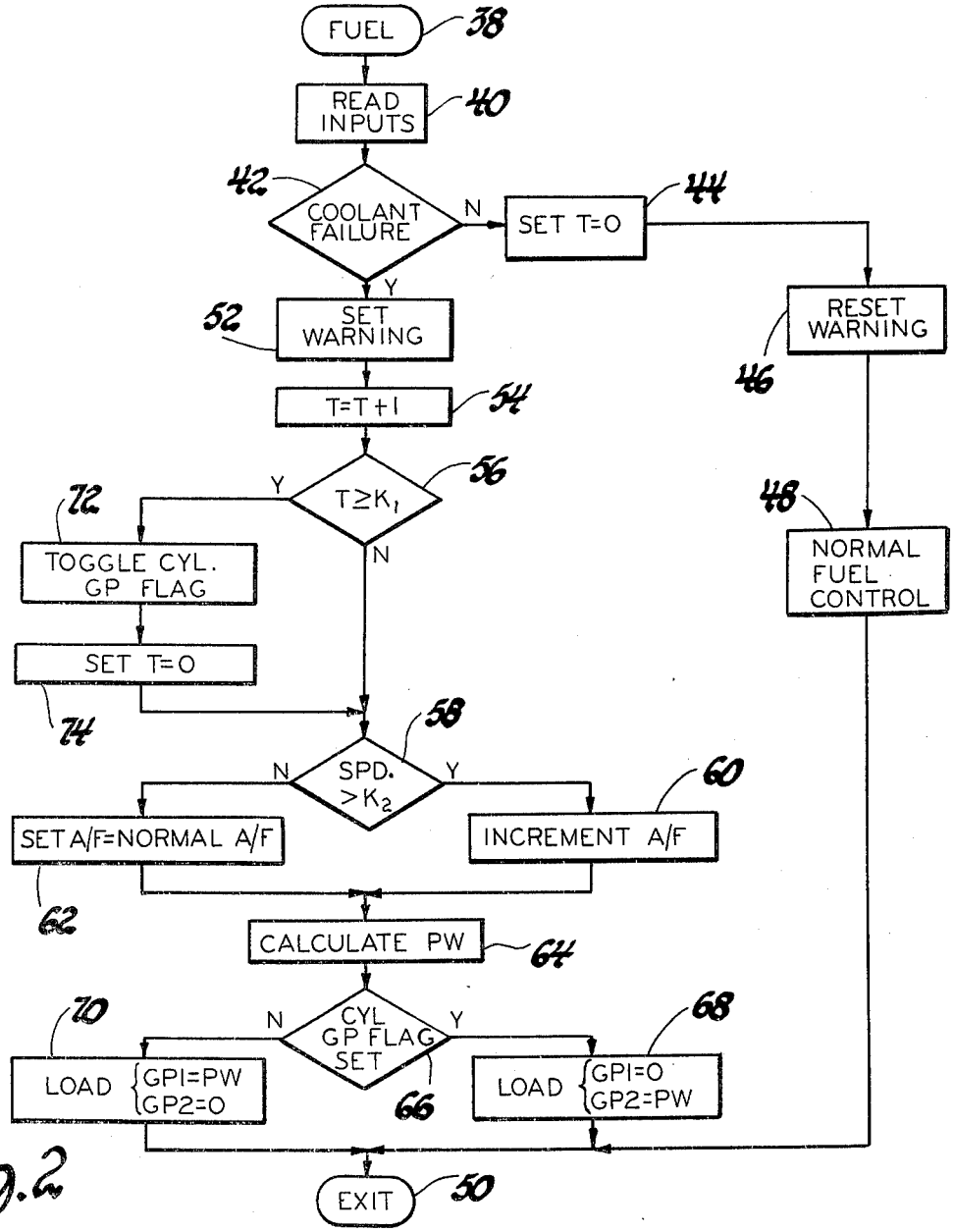

The invention may be best understood by reference to the following description of a preferred embodiment and the drawings in which:

FIG. 1 illustrates a fuel injection system for an internal combustion engine incorporating the principles of this invention; and FIG. 2 is a diagram illustrative of the operation of the system of FIG. 1.

Referring to FIG. 1, there is illustrated a fuel control system for a port fuel injected six-cylinder internal combustion engine. The engine is conventional and includes two banks of cylinders with each cylinder being provided with fuel at its intake port by an electromagnetic fuel injector which is supplied with pressurized fuel. When energized, each fuel injector is opened to supply metered amounts of fuel to the intake port of the respective cylinder.

One cylinder bank includes three fuel injectors having windings 10, 12 and 14 coupled in parallel and in series with a Darlington switch 16 between ground and the vehicle battery voltage V+ which may be supplied thereto via the ignition switch. The remaining cylinder bank includes three fuel injectors having windings 18, 20 and 22 coupled in parallel and in series with a Darlington switch 24 between ground and the battery voltage V+.

When the Darlington transistors 16 and 24 are biased conductive, the injector windings 10 through 14 and 18 through 22 are energized to meter fuel to the intake ports of the respective cylinders. The Darlington transistors 16 and 24 are controlled to provide the fuel requirement of the engine by an engine control module generally designated 26 that responds to various vehicle engine operating parameters and provides injection control signals to the Darlingtons 16 and 24 via respective driver circuits 28 and 30. During normal engine operating conditions, the injector windings 10 through 14 and 18 through 22 are all simultaneously energized for timed periods calculated to provide fuel to establish a desired ratio of the air-fuel mixture drawn into each of the cylinders of the internal combustion engine.

The engine control module 26 takes the form of a digital computer. The digital computer is standard in form and includes a central processing unit (CPU) which executes an operating program permanently stored in a read-only memory (ROM) which also stores tables and constants utilized in determining the fuel requirements of the engine. Contained within the CPU are conventional counters, registers, accumulators, flag flip flops, etc. along with a clock which provides a high frequency clock signal.

The engine control module 26 also includes a random access memory (RAM) into which data may be temporarily stored and from which data may be read at various address locations determined in accord with the program stored in the ROM. A power control unit (PCU) receives battery voltage V+, which may be through the vehicle ignition switch and provides regulated power to the various operating circuits in the engine control module 26. The engine control module 26 also includes an input/output circuit (I/0) that includes a pair of output counter sections. Each output counter section is independently controlled by the CPU to provide timed injection pulses to the driver circuits 28 and 30 for energizing the respective injector windings 10, 12, 14 and 18, 20, 22. The I/O also includes a discrete output port for selectively energizing a driver transistor 32 via a driver circuit 34 to energize a coolant failure warning lamp 36 as will be described. This discrete output port may take the form of the output of a flip flop that is set or reset by the CPU to selectively energize or deenergize the warning lamp 36.

The I/O also includes an input counter section which receives a pulse output from a conventional vehicle speed sensor which may be located in the vehicle transmission and a pulse output of a conventional vehicle distributor which generates a pulse for each cylinder during each engine cycle. The pulses from the vehicle speed sensor are used to determine vehicle speed and the distributor pulses are used for determining engine speed and for initiating the energization of the fuel injector solenoid windings 10, 12, 14, 18, 20 and 22. In this respect, vehicle speed and engine speed may each be determined by counting clock pulses from the internal clock between pulses.

The engine control unit 26 also includes an analog-to-digital unit (ADU) which provides for the measurement of analog signals and the sensing of discrete (on/off) signal levels. Discrete signals are applied to discrete inputs of the ADU and the various analog signals to be measured are applied to analog inputs.

In the present system, a single discrete signal is used that represents the high or low state of the coolant level in the coolant system of the internal combustion engine. This signal is provided by a conventional liquid sensing element in the coolant system and applied to the discrete input of the ADU. Analog signals representing conditions upon which the injection pulse widths are based and for determining a coolant system failure are supplied to the analog inputs of the ADU. In the present embodiment, those signals include a manifold absolute pressure signal MAP provided by a conventional pressure sensor and an engine metal temperature signal TEMP provided by a conventional temperature sensing element mounted in the engine block to sense engine temperature.

The CPU reads and stores the high or low state of the discrete input to the ADU in a designated RAM memory location in accord with the operating program stored in the ROM. The analog signals are each sampled and converted under control of the CPU. The conversion process is initiated from command of the CPU which selects the particular analog input channel to be converted. At the end of the conversion cycle, the ADU generates an interrupt after which the digital data is read over the data bus on command from the CPU and stored in ROM designated RAM memory locations.

The various elements of the engine control module 26 are interconnected by an address bus, a data bus and a control bus. The CPU accesses the various circuits and memory locations in the ROM and the RAM via the address bus. Information is transmitted between the circuits via the data bus and the control bus includes conventional lines such as read/write lines, reset lines, clock lines, power supply lines, etc.

In general, and in the absence of a coolant system failure, the fuel injector windings 10 thru 14 and 18 thru 22 are all simultaneously energized with each intake event and for a time duration determined to provide a predetermined air/fuel ratio such as the stoichiometric ratio. This is accomplished by calculating the required pulse width based on mass air flow determined from the measured manifold absolute pressure and the volume of the cylinders, the known injector flow rates, and the desired air/fuel ratio. The injection pulses are issued to the driver circuits 28 and 30 simultaneously via the I/O under control of the CPU for providing the desired injection quantity.

In the event of a coolant system failure which results in a loss of coolant or an increase in the engine temperature above a predetermined level, the CPU issues an output to the driver circuit 34 via the I/O to energize the warning light 36 to indicate the failure to the vehicle operator. At the same time, the CPU alternately inhibits the supply of fuel to each of the banks of cylinders for predetermined time periods substantially greater than the period of an engine cycle so that the first and second banks of cylinders alternately induct an air and fuel mixture and air only during the period of the cooling system failure. The bank of cylinders inducting air only are cooled by the air. After the predetermined time period, such as 15 seconds, the two cylinder bank functions are switched and the cylinders which previously inducted a combustible mixture induct air only to be cooled thereby. In this manner, the safe operating time of the engine is extended.

Alternate operation of the cylinder banks during the period of a coolant system failure is provided by supplying fuel injection pulses alternately to the drivers 28 and 30 for the predetermined time period. While fuel injection pulses are being provided to one of the drivers 28 or 30 for the time period to provide a combustible mixture to the corresponding cylinders, the output to the other driver is maintained off so that air only is inducted into the corresponding cylinders which are cooled thereby. The periodic cooling of each of the banks of cylinders decreases the rate of increase in the temperature of the engine and thereby extends the safe operating time of the engine.

In addition to the above-described operation during a sensed coolant failure, the CPU limits the vehicle speed to a predetermined maximum value. This is accomplished by adjusting the air/fuel ratio of the mixture supplied to the enabled cylinder bank so that a maximum speed cannot be exceeded. By so limiting the vehicle speed, the rate of increase in the temperature of the engine is further reduced to further extend the safe operating time of the engine.

Referring to FIG. 2, the fuel control routine executed by the computer of FIG. 1 is illustrated. This routine is initiated by the CPU at constant intervals such as 10 millisecond intervals. The fuel control routine is entered at point 38 and then proceeds to a step 40 where the various engine operating parameters are read and stored in ROM designated RAM locations. At this step, the discrete input channel of the ADU at which the coolant level input signal is applied is sampled to determine whether or not a coolant failure has occurred as represented by the coolant level switch. The program also executes the analog-to-digital conversion of the manifold absolute pressure and the engine temperature signals and stores the resulting digital numbers at ROM designated RAM locations. The vehicle speed is also sampled from the input counter section of the I/O and stored in a ROM designated RAM location.

Following the read routine 40, the program proceeds to a decision point 42 where it is determined if the conditions read and stored at step 40 represent a failure in the coolant system. If neither the state of the coolant level switch or the engine temperature represents a coolant system failure, the program proceeds to a step 44 where a timing register in the RAM is reset to zero. Thereafter the program proceeds to a step 46 where the output discrete from the I/O circuit of the engine control module 26 to the driver 34 is reset to deenergize the warning lamp 36. From step 46, the program proceeds to a step 48 where a normal fuel control routine is executed during which the required fuel injection duration is calculated based on the engine operating parameters and a desired air/fuel ratio and set into the output counter sections of the I/O of FIG. 1. The I/O issues a pulse for the determined duration to each of the drivers 28 and 30 upon the occurrence of a distributor pulse to energize all of the fuel injector windings 10, 12, 14, 18, 20 and 22 and provide fuel to all of the cylinders. From step 48 the program exits the fuel control routine at step 50. As long as no failure occurs in the coolant system, the foregoing steps are repeated and the fuel pulse width is continually updated and loaded into the output counters in the I/O, the injection pulse being issued upon the receipt of a distributor pulse.

If the coolant level in the engine decreases to the level sensed by the coolant level sensor or the engine temperature increases to a predetermined level representing a coolant system failure, the condition is detected at step 42 and the program proceeds to step 52 where the discrete output of the I/O applied to the driver 34 of FIG. 1 is set to energize the warning lamp 36. Thereafter, the timing register previously set at step 44 is incremented at step 54. The count in this register represents the time that the engine is operated on one of the banks of cylinders as will be described. From step 54, the program proceeds to a decision point 56 where the count in the timing register is compared with a constant $K_1$ representing the maximum time of continuous operation of the group of cylinders in one of the cylinder banks.

Assuming the count in the timing register is less than the constant $K_1$, the program proceeds from point 56 to a decision point 58 where the speed of the vehicle stored at step 40 is compared with a calibration constant $K_2$ representing the maximum allowable vehicle speed during a coolant system failure. If the speed is greater than $K_2$, the program proceeds to a step 60 where the desired air/fuel ratio used during the prior execution of the fuel control routine is incremented to effect a leaning of the air-fuel mixture supplied to the operating cylinders. However, if the speed of the vehicle is less than the maximum allowable speed, the program proceeds from decision point 58 to a step 62 where the air/fuel ratio is set to the normal operating air/fuel ratio which is the same as used at step 48 previously described. From either of the steps 60 or 62, the program proceeds to a step 64 in which the injector pulse width required to achieve the desired air/fuel ratio established at steps 60 or 62 is calculated.

From step 64, the program proceeds to a decision point 66 to determine which bank of cylinders is currently operating. This is determined by sampling a cylinder group flag. A set condition of this flag represents operation of the group of cylinders in one of the cylinder banks and a reset condition represents operation of the group of cylinders in the other cylinder bank. Assuming the cylinder group flag is set, the program proceeds to a step 68 where an injection pulse width equal to zero is loaded into the output counter in the I/O controlling the fuel injectors associated with the cylinders in one bank (GP1 cylinders) and where the injection pulse width calculated at step 64 is loaded into the I/O output counter controlling the fuel injectors associated with the cylinders in the other bank (GP2 cylinders). When a distributor pulse is provided to the I/O, the respective injection pulse widths are issued to the drivers 28 and 30. However, since the injection pulse width associated with the GP1 cylinders is zero, the injectors associated with those cylinders remain deenergized while fuel is provided to the GP2 cylinders by the fuel injectors associated with those injectors.

If at decision point 66, it is determined that the cylinder group flag is reset, the program proceeds to a step 70 where the injection pulse width calculated at step 64 is loaded into the I/O output counter controlling the fuel injectors associated with the GP1 cylinders and where an injection pulse width of zero is loaded into the I/O output counter controlling the fuel injectors associated with the GP2 cylinders. Upon receipt of a distributor pulse, the respective injection pulse widths are issued resulting in the injectors associated with the GP2 cylinders remaining deenergized and the injectors associated with the GP1 cylinders providing fuel to the respective cylinders. From step 68 or 70, the program exits the fuel control routine at step 50.

The foregoing steps 52 through 66 and step 68 or 70 are continually executed until it is determined at decision point 56 that fuel has been supplied to the group of cylinders in one of the banks for the time period $K_1$. When this condition is detected, the program proceeds from the decision point 56 to a step 72 where the cylinder group flag is toggled so that at decision point 66 in the program, the operation of the two banks of cylinders are reversed. At step 74, the timing register in the RAM is set to zero to again begin timing the time period $K_1$. In the foregoing manner, an air-fuel mixture and air only are alternately provided to the two groups of cylinders associated with the two cylinder banks. Further, the air/fuel ratio is continually adjusted to limit the engine speed to the predetermined maximum value $K_2$.

When the coolant failure condition is corrected, the program again returns to normal fuel control via decision point 42 and steps 44, 46 and 48 to supply fuel to all six of the cylinders of the engine in the normal manner.

The foregoing description of a preferred embodiment for purposes of illustrating the invention is not to be considered as limiting or restricting the invention since many modifications may be made by the exercise of skill in the art without departing from the scope of the invention.

The embodiments of the invention in which an exclusive property or privilege is claimed are defined as follows:

1. A fuel control system for a vehicle internal combustion engine having a cooling system and first and second groups of cylinders, the fuel control system comprising:

means effective to supply fuel for induction with air into each of the cylinders of the first and second groups to undergo combustion;

means effective to monitor the condition of the cooling system and provide a warning signal when the condition represents a cooling system failure; and means responsive to the warning signal effective to alternately inhibit the supply of fuel to the cylinders in each of the first and second groups of cylinders for predetermined time periods substantially greater than the period of an engine cycle so that the first and second groups of cylinders alternately induct an air and fuel mixture and air only during a cooling system failure, the cylinders of the group inducting air only being cooled thereby to extend the safe operating time of the engine during the period of a cooling system failure.

2. A fuel control system for a vehicle internal combustion engine having a cooling system and first and second banks of cylinders, the fuel control system comprising:

first injector means effective to supply fuel for induction with air into the first bank of cylinders to undergo combustion;

second injector means effective to supply fuel for induction with air into the second bank of cylinders to undergo combustion;

means effective to monitor the condition of the cooling system and provide a warning signal when the condition represents a cooling system failure; and means responsive to the warning signal effective to alternately inhibit the first and second injector means for predetermined time periods substantially greater than the period of an engine cycle so that the first and second banks of cylinders alternately induct an air and fuel mixture and air only during a cooling system failure, the cylinders of the bank inducting air only being cooled thereby to extend the safe operating time of the engine during the period of a cooling system failure.

3. The system of claim 1 further including means effective to sense vehicle speed and means responsive to the warning signal and the sensed vehicle speed effective to increase the air/fuel ratio of the fuel and air inducted into the cylinders during a coolant failure when the vehicle speed is greater than a predetermined value to a ratio limiting the vehicle speed to the predetermined value to further extend the safe operating time of the engine during the period of a cooling system failure.

4. A method of controlling fuel in an internal combustion engine having a cooling system and first and second groups of cylinders, the method comprising the steps of:

supplying fuel for induction with air into each of the cylinders of the first and second groups to undergo combustion;

sensing a cooling system failure; and alternately inhibiting the supply of fuel to the cylinders in each of the first and second groups of cylinders for predetermined time periods substantially greater than the period of an engine cycle during a sensed cooling system failure so that the first and second groups of cylinders alternately induct an air and fuel mixture and air only during a cooling system failure, the cylinders of the group inducting air only being cooled thereby to extend the safe operating time of the engine during the period of a cooling system failure.

* * * * *